US005733022A

United States Patent [19]

Whetstone

[11] Patent Number: 5,733,022

[45] Date of Patent: Mar. 31, 1998

[54] BACKSPLASH AND COUNTERTOP ASSEMBLY

[75] Inventor: William F. Whetstone, Cincinnati, Ohio

[73] Assignee: Formica Technology, Inc., Wilmington, Del.

[21] Appl. No.: 431,915

[22] Filed: Apr. 28, 1995

[51] Int. Cl.[6] ..... A47B 96/18

[52] U.S. Cl. ..... 312/140.4; 108/27; 4/631; 4/658

[58] Field of Search ..... 312/140.4, 140.3, 312/140.2, 140.1; 108/27, 48, 42; 4/631, 658, 654, 656, 692, 619, 632, 633, 634, 635, 636, 637; 52/35, 287.1, 288.1

[56] References Cited

U.S. PATENT DOCUMENTS

| | | | |
|---|---|---|---|
| D. 329,280 | 9/1992 | Draucek, Sr. . | |
| 2,626,846 | 1/1953 | Morris . | |
| 2,646,326 | 7/1953 | Stanitz | 108/42 X |
| 2,847,263 | 8/1958 | Osborne | 108/42 X |
| 3,007,213 | 11/1961 | Hobbs | 52/35 X |
| 3,752,548 | 8/1973 | Betts | 312/140.4 |
| 5,010,703 | 4/1991 | Pearlman et al. | 52/287.1 |
| 5,069,350 | 12/1991 | Wolff et al. . | |
| 5,330,262 | 7/1994 | Peters . | |

FOREIGN PATENT DOCUMENTS

| | | | |
|---|---|---|---|
| 236095 | 10/1964 | Austria | 52/287.1 |

*Primary Examiner*—Peter M. Cuomo
*Assistant Examiner*—Janet M. Wilkens
*Attorney, Agent, or Firm*—Richard A. Speer; Mayer, Brown & Platt

[57] ABSTRACT

A backsplash is configured for a stable and permanent attachment to a countertop surface. The backsplash has a substantially elongated flat member which has a front face and a back face. The elongated member has extending from it near its bottom a first thin base ledge, a second thin base ledge, and a gripper flange. The first base ledge extends at a substantially right angle from the front face of the elongated member. The second base ledge extends at a substantially right angle from the back face of the elongated member, opposite the first base ledge. The gripper flange extends vertically from the flat member. A recess in the countertop surface is configured to frictionally receive the gripper flange and to also receive the first and second base ledges. An adhesive is used with the base ledges to augment the holding force of the gripper flange. A scribe ledge optionally extends from a top edge of the elongated flat member as an aid in installation to get a flush fit against a room wall surface.

14 Claims, 3 Drawing Sheets

BACKSPLASH AND COUNTERTOP ASSEMBLY

This invention relates to a backsplash. More particularly, the invention relates to a backsplash capable of mounting on a countertop in a secure fashion and in a manner so as to form an assembly having the appearance of a seamless unitary structure.

BACKGROUND OF THE INVENTION

Manufactured surface tops are extensively used. Virtually every residence in the country as well as many restaurants and other commercial establishments have one or more countertops. Countertops are a functional part of a kitchen area. They also find use in bathrooms as vanity tops. The countertops must be resistant to stains caused by various household commodities and impervious to liquid. They also must have a surface which is resistant to scratches and other surface marrings. Most importantly, the countertops must be readily cleaned. Edge areas in particular must be readily accessed to be properly cleaned. Besides the functional requirements of the countertop, any countertop must also be attractive to the owner and user. A pleasing color or surface pattern is very important. However, unique edge treatments and a seamless one-piece appearance have also proved to be attributes of a countertop which are important.

Many establishments, particularly homes, require the use of a backsplash with a countertop. Backsplashes are elongated members which extend vertically a short distance above the countertop. The backsplashes are most often placed against a wall. However, sometimes they do extend upwardly from a countertop positioned on a free-standing set of cabinets. In this case the backsplash serves to terminate the countertop work space. Quite often the backsplash is a separately formed elongated rectangular shaped member which is secured to the countertop. Necessarily, the attachment must be permanent. While the backsplash does not normally encounter heavy duty use, occasional and accidental bumpings do occur. Accordingly, any backsplash must be able to withstand such abuse.

The manners in which backsplashes have been attached to countertops in the past have been only marginally adequate. Normally, the backsplash has an adhesive placed on a bottom edge and then properly positioned. It is held by clamps or some other means until the adhesive is set. This is feasible with those countertops wherein the backsplash is positioned adjacent to a vertical room wall. The wall provides a degree of support. However, for those countertops wherein the cabinets are free-standing, the backsplash likely will be subjected to more severe treatment. Accordingly, a mechanical attachment means such as screws ideally are used to gain a more stable and permanent attachment. However, this requires an extra labor step and presents an opportunity for error.

In recent years there have been developed countertop surfaces which are derived from polymers. Solid rigid polymeric sheets are available in sizes about thirty inches wide, twelve feet long and one-fourth to three fourths inches thick. A Surell brand countertop from Formica Corp. is very popular as is a Corian brand countertop from E.I. du Pont de Nemours & Co. The sheets are cut to size and given surface edgings according to the owner's desires. Another popular countertop surface which is somewhat less in cost uses a relatively thin polymeric sheet with an underlying corestock. These products are available in a large sheet form less than about one-eight inch thick. They are readily cut to size by the mechanic. Formica Corp. sells such sheets under its Nuvel trademark. The corestock is initially installed on an underlying structure, e.g. a kitchen cabinet and then the polymeric sheet adhered to the corestock. The corestock provides the needed rigidity while the polymeric sheet provides the needed durability and pleasing appearance.

Backsplashes can be adhered to countertops described above. However, it has proved difficult to get a secure attachment. U.S. Pat. No. 5,330,262 recognizes the difficulty of attaching a backsplash to such countertops. The disclosed manner of alleviating the problem has been to rout a groove into the countertop where the backsplash is to sit. The backsplash itself is given a configured bottom edge which fits into the groove. A coved lip is provided. The backsplash is ultimately adhered to the countertop. The resultant assembly is said to have an attractive appearance. However, its ability to withstand accidental bumpings is suspect.

Any backsplash attachment to the countertop must be secure. It also must result in a countertop assembly which is attractive. Finally, the installer must be able to readily make the attachment without damage to the countertop.

There is still a need for an improved countertop assembly with a backsplash. The assembly must have all the physical characteristics that the home owner as well as the business proprietor have come to expect. Any such assembly must be readily installed to be cost effective and also, of course, must be attractive. In accord with this need there has been developed a backsplash which is readily installed to a countertop to form a permanent assembly capable of withstanding bumps encountered during ordinary usage. The resultant assembly is durable, resistant to food stains, liquid spills, accidental bumps and marrings, and possesses a long lasting attractiveness.

SUMMARY OF THE INVENTION

A backsplash for mounting on a countertop and interfacing with a substantially flat surface countertop forms a countertop assembly which has the appearance of a one piece unit. The backsplash has an elongated substantially flat member with a front face and a back face. A first thin base ledge extends at a substantially right angle from the front face of the elongated member near its bottom. A second thin base ledge also extends at a substantially right angle from the back face of the flat member near the flat member's bottom edge and substantially opposite the first base ledge. Additionally, a gripper flange extends vertically from the elongated substantially flat member and in the same plane. The gripper flange and the two base ledges are configured to sit in a recess on a countertop. The gripper flange provides a mechanical friction fit attachment while adhesive applied on bottom surfaces of the base ledges provides an adhesive attachment. Optionally, a top scribe ledge extends at a substantially right angle from a top of the elongated substantially flat member. The scribe ledge is used for accommodating uneven wall surfaces.

DETAILED DESCRIPTION OF THE INVENTION

The backsplash and countertop assembly of the invention are described in detail in the following paragraphs and with particular reference to the drawings. The backsplash as well as the countertop can be made in an unlimited number of colors and printed patterns to suit the consumer's desires.

Figure 1:
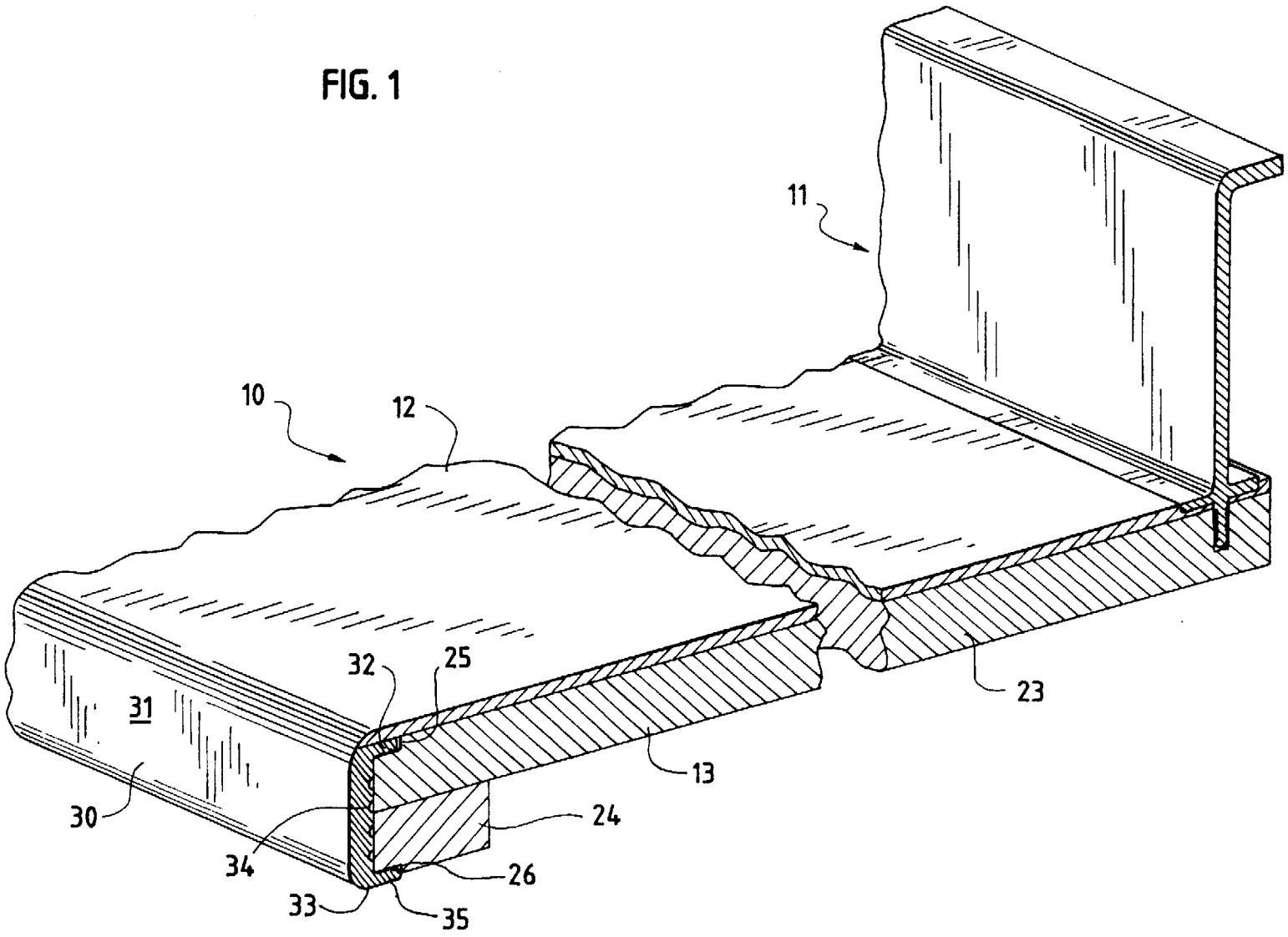
FIG. 1 is a perspective view in section showing a backsplash of the invention mounted on a countertop to form a countertop assembly.

With reference to FIG. 1 there is shown a countertop assembly 10 of the invention. The assembly 10 comprises a backsplash 11 of the invention and a substantially flat surface countertop 12. The countertop 12 is mounted on a corestock 13. The components of the countertop assembly as well their manner of installation on a set of base cabinets or other underlining support structure are described in the following paragraphs.

The backsplash 11 of the invention is a one piece construction formed from a synthetic resin. It is extruded in lengths that typically extend up to about twelve feet long. A highly preferred synthetic resin which is use in its production is a polyester/polycarbonate resin commercially available from General Electric Co. as Nuvel resin. Other resins which provide the needed attributes of a backsplash are usable.

Figure 4:
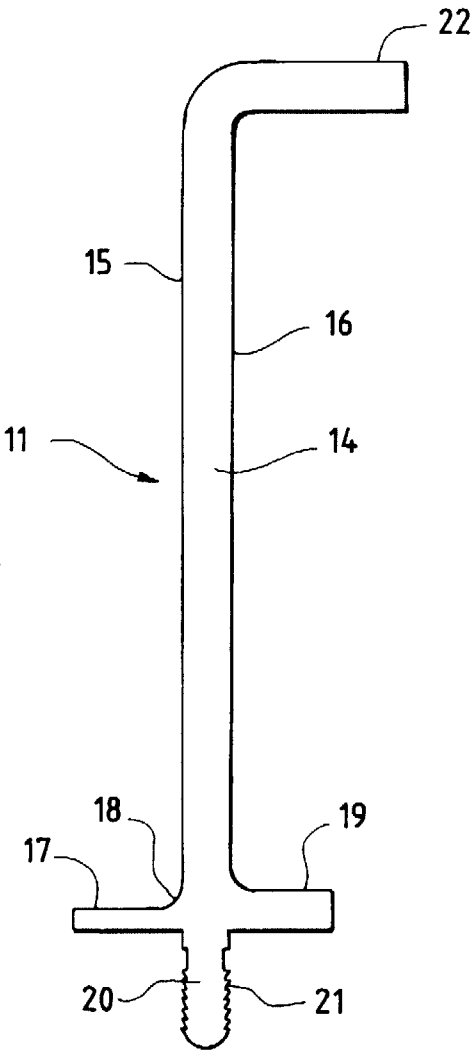
FIG. 4 is an end view of the backsplash of FIG. 3.
Figure 3:
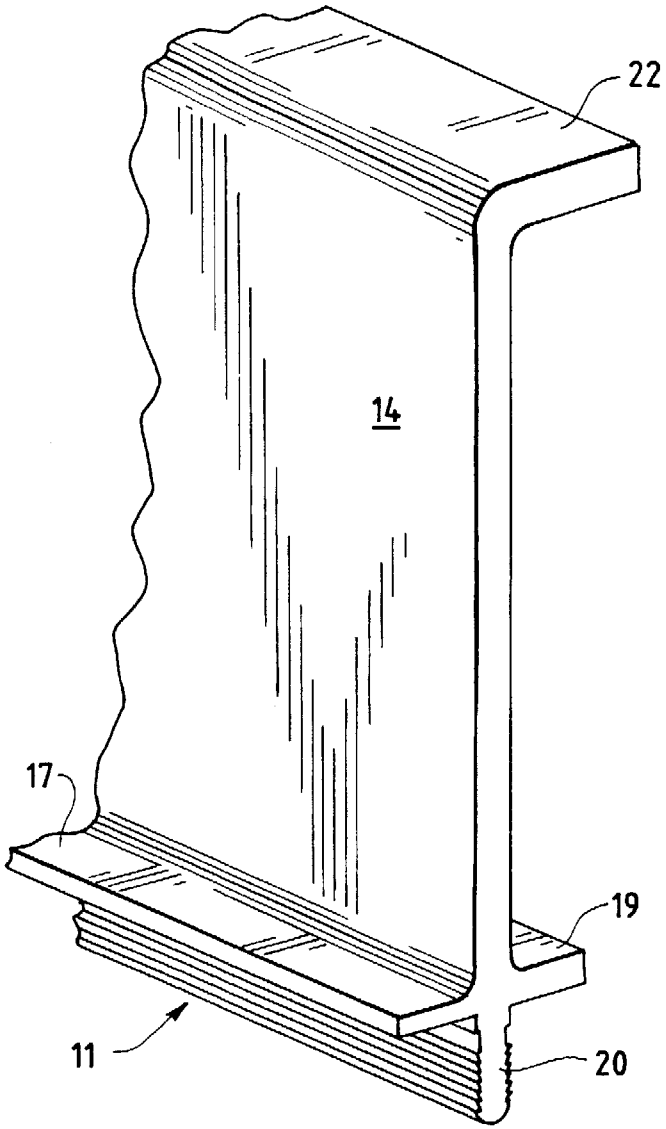
FIG. 3 is a perspective view of the backsplash used in the countertop assembly of FIG. 1.

The backsplash 11 best seen in FIGS. 3 and 4 has an elongated substantially flat member 14. The flat member is generally rectangular shaped. It has a front face 15 and a back face 16. A first thin base ledge 17 extends at a substantially right angle from the front face 15 of the flat member near its bottom. The base ledge 17 extends along the full length of the flat member. Its width is at least about one-fourth inches to provide minimum stability when installed on the countertop as discussed below. A width of from about three-eights wide to about one inch is preferred. Preferably, the top surface of the base ledge where it meets the front face is rounded to provide a coved surface 18. The coved surface is preferred for appearance and cleaning purposes.

A second thin base ledge 19 also extends at a substantially right angle from the back face of the flat member near its bottom. It is substantially opposite the first base ledge 17. While the bottom surfaces of the first and second base ledges must be flat and in the same horizontal plane for proper installation, their top surfaces need not be. The second base ledge 19 also extends along the full length of the flat member and has a width of at least about one-fourth inches, preferably about three-eights inches to about one inch.

A gripper flange 20 extends downwardly from the bottom of the flat member and in coplanar relationship with respect to flat member 14. That is, flange 20 it extends vertically downwardly from member 14 and lies in the same plane as the flat member. As evident in FIG. 3, the gripper flange 20 has a series of lateral ridges 21 for mechanical friction fit gripping purposes as further discussed below. The gripper flange is at least one-fourth inches in length, as measured from the bottom surfaces of the base ledges, and preferably is from abut one-half inches to about one and one-half inches in length.

Optionally, though highly preferred, the flat member 14 has a scribe ledge 22 extending at a substantially right angle from a top edge. The scribe ledge 22 extends from the back face of the flat member and generally parallels the second base ledge 19. Its width is typically from about one-half inches to about two inches. The purpose of the scribe ledge is to accommodate uneven wall surfaces. In installation, the scribe ledge 22 is cut and shaped as needed to fit flush with any wall surface irregularity as well as any uneven wall surface. The scribe ledge is normally not used with a backsplash which is to be installed on a free-standing set of cabinets where a wall is not encountered.

The substantially flat surface countertop 12 used in the countertop assembly 10 is preferably, though not necessarily, made of the same synthetic resin as used in producing the backsplash 11. It is extruded as a flat sheet in widths and lengths dictated primarily by machine limitations as well as by handling and transportation limitations. Typically, polymeric sheets of the countertop range from about two and one-half feet to about five feet in width and about eight feet to about twelve feet in length. Its thickness is not critical, though a sheet thickness of from about 75 mils to about 100 mils is optimum for the end use intended.

Figure 2:
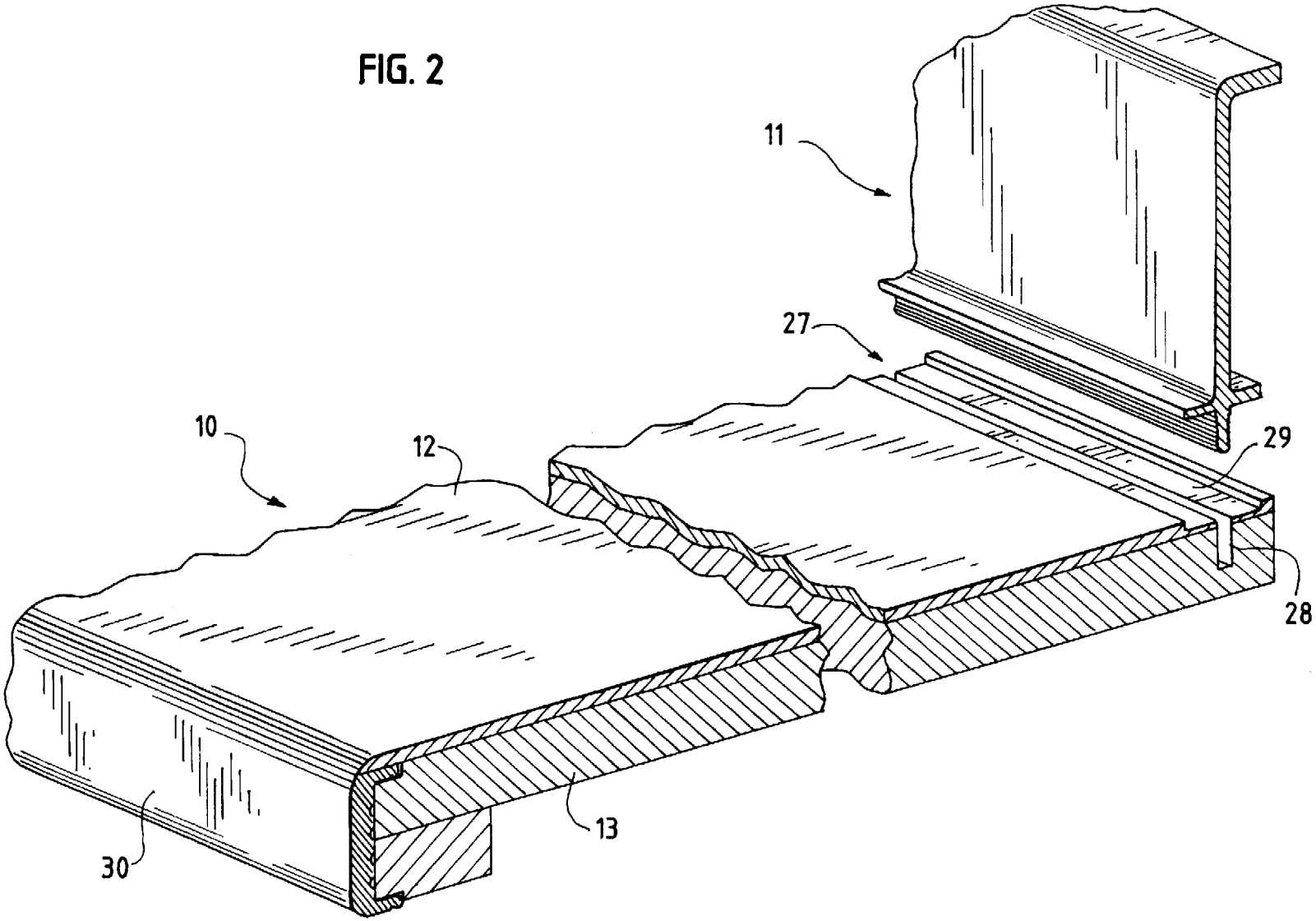
FIG. 2 is an exploded view of the countertop assembly of FIG. 1.

The corestock 13 forming a part of the countertop assembly 10 provides a substantially rigid substrate on which the countertop is adhered. Such corestock are commonly used in countertop assemblies. It is made from wood, plywood, flakeboard, particle board, other wood composites or any other rigid material which is capable of being formed or cut into the shape and size needed. As evident in FIGS. 1 and 2, the corestock 13 has a main body 23 of substantially uniform thickness which sits on a base cabinet (not shown). A shoulder 24 extends along the bottom of the main body 23 near at least one edge thereof. The side edge of the corestock further has a top open-sided channel 25 and a bottom open-sided channel 26 cut into its top and bottom surfaces to receive first and second ledges respectively of the below described preferred edge molding. The channels have a depth and width dependent on the dimensions of the edge molding so as to snugly receive the molding.

Installation of the countertop assembly of the invention is readily accomplished. The main body of the corestock is initially cut to size to fully overly an underlying support structure. Exposed edge areas are created. A recess 27 is now routed into the top surface of the countertop where the backsplash 11 is to be mounted. This routing step can be done before or more typically after installation of the countertop onto the corestock. The recess typically is within about one inch of a back edge. The recess 27 comprises a deep narrow channel 28 to receive the gripper flange of the backsplash and a shallow wide channel 29 to receive the first and second base ledges of the backsplash. The depth of the deep narrow channel 28 is sufficient to fully receive the gripper flange and has a width which results in a friction fit. The depth and width of the shallow wide channel 29 are coordinated with the dimensions of the base ledges width and depth. As should be apparent, the thickness of the first base ledge and the depth of the shallow wide channel are approximately the same. A color-matched adhesive is applied either to the bottom surface of the base ledges or preferably to the shallow wide channel surface. The backsplash is now forced into the recess until the base ledges fit flush in the shallow wide channel. A slight tapping with a hammer or similar tool may be needed to obtain the friction fit of the gripper flange in the deep narrow channel. The friction fit provided by the gripper flange is sufficient to retain a secure mechanical fit while the adhesive sets. Once the adhesive is set and excess removed, the backsplash and countertop appear seamless. The seam which is created remains permanent.

When the backsplash 11 is fully installed in the recess 27, a substantially smooth or slightly elevated surface is provided at the parting line of the first base ledge edge and the recess edge. If elevated, a slight sanding step is needed to present a level surface.

An edge molding is normally installed for a finished edge appearance. A preferred edge molding 30 shown in FIGS. 1 and 2 is made from the same synthetic resin as the backsplash and countertop for uniformity of appearance. It is formed by extrusion and has an elongated body comprised of a facing wall 31, an integral first ledge 32 and an integral second ledge 33. The configuration of this edge molding and its interaction with the countertop is such that the edge molding 30 should be installed on the corestock prior to the countertop being adhered to the corestock as will be apparent. Further, the first and second ledges 31 and 32 extend at substantially right angles to the facing wall 31. The facing wall is typically about one inch to about four inches in height, though can be greater for commercial uses. The width of the ledges is sufficient to extend over the corestock to provide a sturdy attachment, generally about one-fourth inch to about one inch width being adequate.

An inside face of the edge molding's facing wall 31 has at least one, preferably three to five, longitudinally running excess adhesive flow-out grooves 34. An adhesive is used in installation of the edge molding to the corestock as described below. Any excess adhesive used in that step flows into the flow-out grooves 34. This aids in achieving a quicker and better adherence to the corestock.

The first ledge and the second ledge of the edge molding 30 each has a set of longitudinally running gripper ridges on an inside face. The ridges are generally V-shaped to present a surface which can more readily be forced over the corestock and retain its position once properly positioned.

At least the second ledge 33 of the edge molding 30 preferably has a longitudinally running drip channel 35 on an outside face 10 near the ledge's terminus. The drip channel serves the purpose of interrupting the flow of spilled liquid to ensure that it drips onto the floor and not onto a cabinet face.

In a similar manner to the backsplash 11, the edge molding 30 has a color-matched adhesive applied to its inside surfaces and then positioned over the side edge of the corestock. It is forced into position by tapping its facing wall until its first and second ledges fit fully into the channels. The surface top now has the adhesive applied to its underside and positioned onto the corestock. One of its edges slightly overlaps the first ledge of the edge molding. After the adhesive has set, the mechanic can optionally rout the top and bottom outside edges of the edge molding to give them any desired shape, e.g. rounded, ogee, etc. The resultant countertop assembly has the appearance of a unitary construction. The seams formed by the overlap of edge molding to the flat surface countertop and the backsplash to the countertop are virtually unnoticed.

The backsplash of the invention provides distinct advantages. The routing into the countertop surface and corestock to get the recess is relatively simple, well within the skill of the average mechanic. The positioning of the backsplash into the recess and the securing to the countertop is readily accomplished. Any minor adjustment to gain a smooth surface where the countertop and backsplash meet is readily done with a light sanding. The backsplash is permanently secured to the countertop and very capable of withstanding bumps and knocks that occur during normal usage. A seamless appearance which is easily cleaned and remains attractive for a substantial length of time is provided. There is no need for caulking and resultant concern over drying and loosing a water-tight fit. A secondary benefit is that an open area is created as defined by the backsplash's back face, a wall surface, the scribe ledge and countertop. This open area can be used to hold electric wires out of sight. Additionally, the nature of the backsplash allows openings to be cut into its flat member to accomodate-electrical outlets and/or switches.

The invention has been described in detail and with particular reference to the drawings. Various modifications and changes can be made to the described backsplash and countertop assembly. All modifications and changes of an obvious nature are considered within the scope of the appended claims.

I claim:

1. A backsplash for use with a substantially flat countertop to form a stable countertop assembly, said backsplash comprising:

(a) an elongated substantially flat member having a front face and a back face;

(b) first and second base ledges extending from the front and back faces of the elongated substantially flat member at substantially right angles with respect thereto, the ledges having substantially flat bottom faces contained in one common horizontal plane; and (c) a gripper flange extending downwardly from the bottom of the elongated substantially flat member in coplanar relationship with respect to the flat member, whereby the gripper flange, first base ledge and second base ledge lend stability to the backsplash when permanently installed on the countertop.

2. The backsplash of claim 1 further wherein the first base ledge has a curved top surface which extends from near a point it meets the front face of the flat member to a short distance above the first base ledge to form a coved surface.

3. The backsplash of claim 1 further comprising a scribe ledge extending at a substantially right angle from the back face of the flat member at a top edge thereof.

4. The backsplash of claim 3 where the gripper flange has a series of lateral ridges extending therealong to enhance a friction fit of the backsplash to the countertop.

5. The backsplash of claim 4 wherein the flat member has a height of from about two inches to about six inches.

6. The backsplash of claim 5 wherein the first base ledge and the second base ledge each have a width of at least about one-fourth inches.

7. The backsplash of claim 6 wherein the scribe ledge has a width of from about one-half inch to about two inches.

8. The backsplash of claim 1 wherein said backsplash is extruded from a synthetic resin.

9. An extruded backsplash for use with a substantially flat countertop to form a stable countertop assembly, said backsplash comprising:

(a) an elongated substantially flat member having a front face and a back face;

(b) first and second base ledges extending from the front and back faces of the elongated substantially flat member at substantially right angles with respect thereto, the ledges having substantially flat bottom faces contained in one common horizontal plane;

(c) a gripper flange extending downwardly from the bottom of the elongated substantially flat member in coplanar relationship with respect to the flat member, said gripper flange having a set of lateral ridges on each face to aid in forming a function fit when installed on a countertop; and (d) a scribe ledge extending at a substantially right angle from the back face of the flat member at a top edge, whereby the gripper flange, first base ledge and second base ledge lend stability to the backsplash when permanently installed on the countertop.

10. The backsplash of claim 9 further wherein the first base ledge, the second base ledge and the gripper flange extend along the full length of the elongated substantially flat member.

11. The backsplash of claim 9 wherein it is formed from a synthetic resin.

12. The backsplash of claim 9 wherein the elongated substantially flat member has a height of from about two inches to about six inches, the first and second base ledges each have a width of from about three-eighths inches to about one inch and the gripper flange has a length of from about one-half inch to about one and one-half inches.

13. The backsplash of claim 12 further wherein a coved surface is formed where the first base ledge extends from the substantially flat member.

14. A countertop assembly having a unitary seamless appearance, comprising:

(a) a substantially flat surface countertop formed from a synthetic resin wherein a recess is formed near an edge to receive a backsplash, said recess having a shallow wide channel and a deep narrow channel extending vertically from the shallow wide channel; and (b) a backsplash secured to the countertop to form a stable assembly, said backsplash having (i) an elongated substantially flat member have a front face and a back face, (ii) a first thin base ledge extending at a substantially right angle from the front face of the elongated substantially flat member and near said member's bottom, (iii) a second thin base ledge extending at a substantially right angle from the back face of the elongated substantially flat member and near said member's bottom substantially opposite the first thin base ledge, and (iv) a gripper flange extending from the elongated substantially flat member in a same plane and along said elongated substantially flat member's bottom.

* * * * *